United States Patent [19]

DuBois et al.

[11] 3,978,839

[45] Sept. 7, 1976

[54] PRIMER SYSTEM FOR INTERNAL COMBUSTION ENGINE

[75] Inventors: Chester G. DuBois, Zion; Howard M. Pollari, Libertyville, both of Ill.

[73] Assignee: Outboard Marine Corporation, Waukegan, Ill.

[22] Filed: Dec. 18, 1974

[21] Appl. No.: 533,971

[52] U.S. Cl. ..... 123/187.5 R; 123/139 AJ

[51] Int. Cl.[2] ..... F02M 1/16

[58] Field of Search ..... 123/187.5 R, 73 R, 139 AJ, 123/139 A; 417/383, 187.5 P

[56] References Cited

UNITED STATES PATENTS

| | | | |
|---|---|---|---|
| 1,373,625 | 5/1921 | Martinek | 123/187.5 P |
| 2,601,562 | 6/1952 | Schoeppner et al. | 123/187.5 R |
| 2,974,659 | 3/1961 | Wilson | 123/187.5 R |
| 3,805,758 | 4/1974 | May | 123/187.5 R |
| 3,817,227 | 6/1974 | Onishi | 123/73 R |

*Primary Examiner*—Wendell E. Burns

*Attorney, Agent, or Firm*—Michael, Best & Friedrich

[57] ABSTRACT

Disclosed herein is an internal combustion engine including a cylinder having a head end, a piston reciprocal in the cylinder relative to the head end, a port communicating with the cylinder in spaced relation to the head end and subject to pressure variation in response to piston reciprocation, a manually operable primer pump communicating with the port for pumping primer fuel into the cylinder through the port, and a fuel pump including a pulse chamber defined in part by a diaphram communicating with the port and operable in response to pressure variation to effect fuel pumping operation.

9 Claims, 2 Drawing Figures

PRIMER SYSTEM FOR INTERNAL COMBUSTION ENGINE

BACKGROUND OF THE INVENTION

This invention relates to internal combustion engines and, more particularly, to primer systems for internal combustion engines.

Internal combustion engines are sometimes difficult to start when cold or after sitting inoperative for some time.

SUMMARY OF THE INVENTION

In accordance with the invention, starting of an internal combustion engine is made easier and quicker by providing means operable independently of engine operation for pumping a quantity of primer fuel directly into the cylinder for subsequent compression and ignition.

More specifically, in accordance with the invention, there is provided an internal combustion engine including a cylinder having a head end, a piston reciprocal in the cylinder relative to the head end, a port communicating with the cylinder in spaced relation to the head end and subject to pressure variation in response to piston reciprocation, and manually operable primer pump means for pumping primer fuel into the cylinder through the port.

In accordance with a preferred embodiment of the invention, there is also included a fuel pump including a pulse chamber defined in part by a diaphragm operable in response to pressure variation to effect fuel pumping operation, and conduit means communicating between the port and the pulse chamber. In one form of the invention, the primer pump means communicates with the port directly through the conduit means, and in another form of the invention, the primer pump means communicates with the port through the conduit means through the pulse chamber.

In an embodiment of the invention, there is also provided a crankcase extending from the cylinder, and a transfer passage extending between the crankcase and the cylinder and operable to provide communication between the crankcase and the cylinder when the piston is spaced from the cylinder head end, and in which the port communicates with the transfer passage adjacent to the cylinder.

In another embodiment in accordance with the invention, the cylinder includes a side wall having therein an exhaust port spaced from the cylinder head end and the port subject to pressure variation is located in the side wall at a distance from the cylinder head end less than the distance of the exhaust port from the cylinder head end.

In further accordance with one embodiment of the invention, there is also provided a one-way valve means located between the port subject to pressure variation and the primer pump means for permitting flow from the primer pump means to the cylinder and for preventing flow from the cylinder to the primer pump means.

One of the principal features of the invention is the provision of a fuel primer system for an internal combustion engine to facilitate starting of the engine.

Another of the principal features of the invention is the provision of an internal combustion engine including means operable independently of engine operation for pumping a quantity of primer fuel directly into the combustion chamber.

Still another of the principal features of the invention is the provision of a fuel primer system for an internal combustion engine requiring minimum modification to existing engine constructions.

Other features and advantages of the invention will become apparent upon reviewing the following detailed description, the drawings, and the appended claims.

Figure 1:
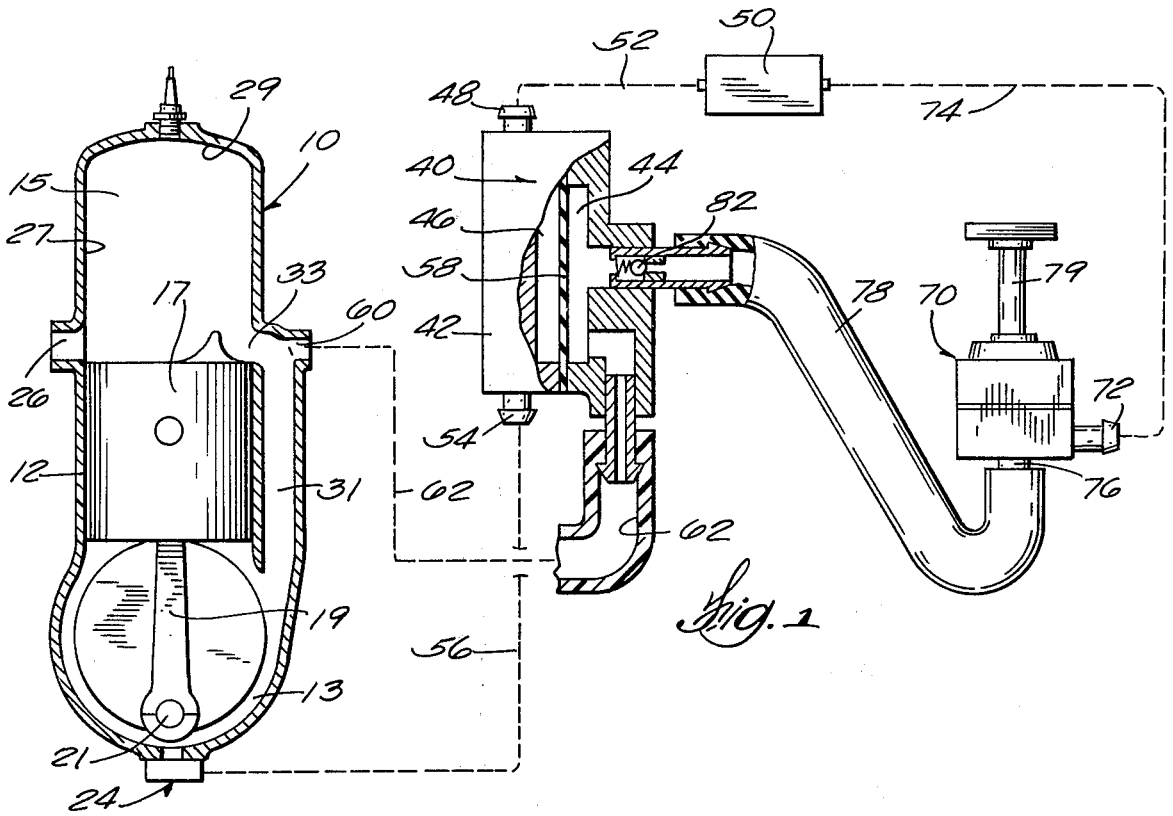
FIG. 1 is a fragmentary and partially diagrammatic view of an internal combustion engine embodying various of the features of the invention.

Before explaining the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein is for the purposes of description and should not be regarded as limiting.

GENERAL DESCRIPTION

Shown in FIG. 1 is an internal combustion engine 10 including an engine block member 12 defining a crankcase 13 and cylinder 15 which extends from the crankcase 13 and in which a piston 17 is reciprocable. In turn, the piston 17 is connected by a rod 19 to a crankshaft 21 rotatably extending through the crankcase 13.

Also included in the engine block member 12 is an exhaust port 26 which is located in the cylinder side wall 27 in spaced relation from the cylinder head end 29 and which, subject to piston reciprocation, communicates with the cylinder 15. Also included in the engine block member 12 is a transfer passage 31 which, subject to piston reciprocation, communicates between the crankcase 13 and the cylinder 15. More specifically, the transfer passage 31 terminates, at one end, in a transfer port 33 located in the cylinder side wall 27 so as to be opened, during piston travel from the cylinder head end 29, prior to arrival at bottom dead center and after opening of the exhaust port 26.

Mounted on the crankcase 13 is a carburetor 24 which feeds a fuel air mixture to the crankcase 13 in response to pressure variation occurring in the crankcase incident to piston reciprocation. The pressure variation occurring in the crankcase 13 also extends into the transfer passage 31 and to the transfer port 33. Any suitable carburetor construction can be employed.

Connected to the carburetor 24 is a fuel pump for supplying a positive flow of fuel to the carburetor 24 during engine operation. While various arrangements can be employed, in the specific construction illustrated in FIG. 1, there is shown a conventional diaphragm type fuel pump 40 including a housing 42 defining a pressure or pulse chamber 44 and a fuel chamber 46 having an inlet 48 connected to a fuel tank 50 (shown diagrammatically) by a supply line (illustrated by dash line 52) and an outlet 54 connected to the carburetor 24 by a feed line (illustrated by dash line 56). The fuel chamber 46 and the pulse chamber 44 are separated by a resilient member or diaphragm 58 which serves to pump fuel from the fuel tank 50 to the carburetor 24 in response to pressure variation in the pulse chamber 44.

In accordance with the invention, starting of the engine is facilitated, i.e., made quicker and easier, by providing means operable independently of engine operation for selectively pumping a quantity of primer fuel directly into the cylinder 15 at a location where the fuel is subsequently compressed and ignited with within the cylinder 15. More specifically, in accordance with the invention, there is provided a manually operated primer pump 70 which communicates with the cylinder 15 through a port 60 which is subject to cyclical pressure variation and which also communicates through a suitable pulse conduit 62 with the pulse chamber 44 so as to effect fuel pumping operation incident to engine operation.

More specifically, during engine operation, the diaphragm 58 is oscillated in response to crankcase pressure variations acting through the port 60 and conduit 62 so as to pump fuel from the fuel tank 50 to the carburetor 24 for subsequent supply to the crankcase 13.

While other arrangements are possible in the construction illustrated in FIG. 1, the port 60 communicates with the transfer passage 31 immediately adjacent to the cylinder 15 and is preferably arranged so that the fuel delivered therefrom in response to primer pump operation is directed into the cylinder 15. (In FIG. 1, the port 60 has been substantially enlarged for purposes of illustration.) In order to insure flow of the primer fuel into the cylinder 15, the piston 17 should be located adjacent to bottom dead center when the primer pump operation takes place. In most engines, upon discontinuance of engine operation, the piston will automatically come to rest adjacent to bottom dead center.

While various primer pump arrangements can be employed in the illustrated construction, the primer pump 70 is of the diaphragm type and has an inlet 72 connected by a flexible line (illustrated by dash line 74) to the fuel tank 50 and an outlet 76 connected (in part) by a fuel injection line 78 to the port 60. The primer valve 70 is actuated, to selectively pump a predetermined quantity of primer fuel under positive pressure into the injection line 78, by depressing and releasing a plunger 79 operatively connected to an internal diaphragm (not shown) or by similar means which serves to pump a quantity of fuel from the primer pump 70. Various conventional primer pumps or other suitable means can be used for selectively pumping a quantity of primer fuel under positive pressure into the injection line 78. Therefore, a more detailed description of the primer pump is not deemed necessary for full understanding of the invention.

It is noted that in the construction illustrated in FIG. 1, the injection line 78 is connected to the pulse chamber 44 so that primer fuel flow is from the primer pump 70, through the injection line 78, through the pulse chamber 44, through the pulse conduit 62, and from the port 60 into the cylinder 15.

In order to prevent backflow of fuel from the cylinder 15 toward the primer pump 70, there is provided, between the primer pump 70 an the pressure port 60, a suitable one-way valve, such as a ball check valve 82. The fluid pressure produced by actuation of the primer pump 70 is sufficient to open the check valve 82 and to permit fuel flow from the primer pump 70 into the cylinder 15 when a relatively low pressure exists therein, such as is the case before engine operation is initiated.

In the construction illustrated in FIG. 1, the check valve 82 is located between the pulse chamber 44 and the primer pump 70 so as to not interfere with normal operation of the fuel pump 40, i.e., so as not to interfere with communication of the pressure pulses from the crankcase 13 to the pulse chamber 44.

Figure 2:
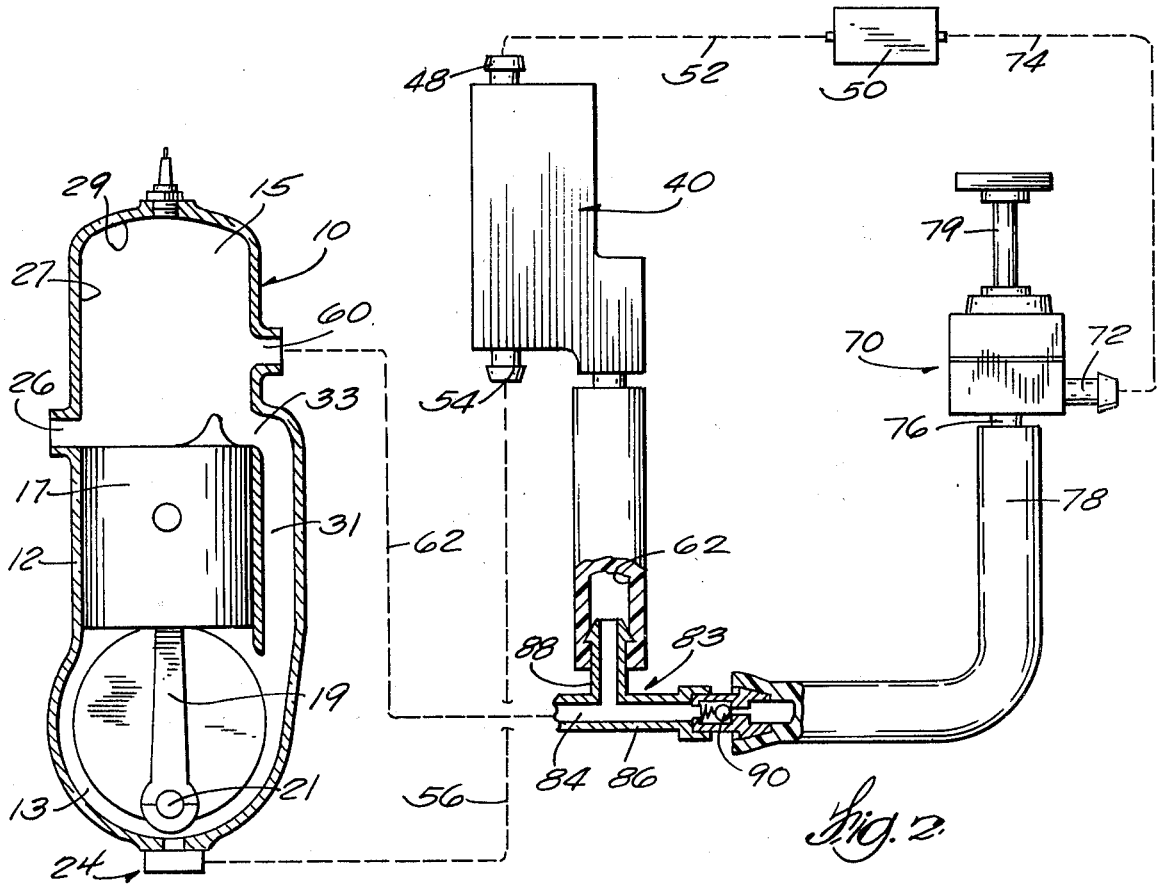
FIG. 2 is a fragmentary and partially diagrammatic view of another embodiment of an internal combustion engine embodying various of the features of the invention.

Shown in FIG. 2 is another embodiment of the invention including various components which are similarly constructed and arranged as shown in FIG. 1 except as noted hereinafter. Thus, the same reference numerals have been applied in FIG. 2 as have been applied in FIG. 1 with respect to corresponding components. The engine 10 shown in FIG. 2 differs from the engine 10 shown in FIG. 1 in that the port 60 (shown in enlarged condition in FIG. 2) is located in the cylinder side wall 27 at a distance from the cylinder head end 24 less than the distance from the cylinder head end 24 to the exhaust port 26. During piston reciprocation under normal operating conditions, the port 60 (shown in FIG. 2) will experience pressure variation. It is preferred that the port 60 be located relatively adjacent to the exhaust port 26 in order to reduce the magnitude of the variation in pressure which could occur if the port 60 were located in closely adjacent relation to the cylinder head end 29.

As in the construction shown in FIG. 1, the port 60 communicates with a pressure pulse conduit 62 communicating with the pulse chamber 44 of a fuel pump 40 so as to effect pumping operation thereof in response to engine operation. However, as compared to the construction shown in FIG. 1, the injection line 78 communicates with the port 60 through the pressure pulse conduit 62 independently of the pulse chamber 44 of the fuel pump 40. Thus, in the construction shown in FIG. 2, primer fuel does not pass through the pulse chamber 44 of the fuel pump 40 but passes directly from the injection line 78 to the port 60 through the portion of the pulse conduit 62 extending from the port 60. More specifically, in the construction illustrated in FIG. 2, there is provided a T-fitting 83 having one leg 84 communicating with the port 60, one leg 86 communicating with the fuel injection line 78, and one leg 86 communicating with the pressure pulse conduit 62. Located at the connection between the leg 86 and the fuel injection line 78 is a suitable one-way valve such as a ball check valve 90 for preventing flow from the port 60 to the primer pump 70 while permitting flow from the pump 70 to the port 60. During engine operation after starting, the normally closed check valve 90 isolates the pressure pulse conduit 62 from the primer pump 70 so that the fuel pump 40 can operate in the usual manner. A one-way valve may be omitted when the primer pump 70 includes a built-in back flow prevention feature.

Incorporation of the direct injection fuel priming feature provided by the invention requires minimum structural modifications to many existing internal combustion engine constructions, particularly those employing a pressure motivated fuel pump.

If desired, the conduit system shown in FIG. 2 (wherein the primer fuel is not pumped through the pulse chamber 44) can be connected to the port 60 located in the transfer passage 31 as shown in FIG. 1. In addition, if desired, the pressure pulse conduit 62 shown in FIG. 1 could be connected to a port 60 such as shown in FIG. 2 so that primer fuel could be supplied to the cylinder 15 through the port 60 via the pressure pulse chamber 44.

Various of the features of the invention are set forth in the following claims.

What is claimed is:

1. An internal combustion engine including a cylinder having a head end, a piston reciprocal in said cylinder relative to said head end, a port communicating with said cylinder in spaced relation to said head end and subject to pressure variation occurring in response to piston reciprocation, conduit means communicating with said port, a pressure operated fuel pump including a diaphragm defining a pulse chamber communicating with said conduit means and a pumping chamber operable in response to pressure variation in said pulse chamber to effect fuel pumping, and manually operable primer pump means communicating with said port for pumping primer fuel into said cylinder through said port.

2. An internal combustion engine in accordance with claim 1 wherein said primer pump means communicates with said port through said conduit means.

3. An internal combustion engine in accordance with claim 1 wherein said primer pump means communicates with said port through said conduit means and said pulse chamber.

4. An internal combustion engine in accordance with claim 1 and further including a crankcase extending from said cylinder, and a transfer passage extending between said crankcase and said cylinder and operable to provide communication between said crankcase and said cylinder when said piston is spaced from said cylinder head end, and wherein said port communicates with said transfer passage adjacent to said cylinder.

5. An internal combustion engine in accordance with claim 1 wherein said cylinder includes a side wall having therein an exhaust port spaced from said cylinder head end and wherein said port subject to pressure variation is located in said side wall at a distance from said cylinder head end less than the distance of said exhaust port from said cylinder head end.

6. An internal combustion engine in accordance with claim 1 including a one-way valve means located between said port subject to pressure variation and said primer pump means for permitting flow from said primer pump means to said cylinder and for preventing flow from said cylinder to said primer pump means.

7. An internal combustion engine including a combustion chamber, a piston movable in said combustion chamber to vary the pressure in said chamber, a port communicating with said combustion chamber and subject to pressure variation occurring in response to piston movement, conduit means communicating with said port, a pressure operated fuel pump including a diaphragm defining a pulse chamber communicating with said conduit means and a pumping chamber operable in response to pressure variation in said pulse chamber to effect fuel pumping, and manually operable primer pump means communicating with said port for pumping primer fuel into said combustion chamber through said port.

8. An internal combustion engine in accordance with claim 7 wherein said primer pump means communicates with said port through said conduit means.

9. An internal combustion engine in accordance with claim 7 wherein said primer pump means communicates with said port through said conduit means and said pulse chamber.

* * * * *